US011384606B2

(12) United States Patent
Kellner et al.

(10) Patent No.: US 11,384,606 B2
(45) Date of Patent: Jul. 12, 2022

(54) STOP COLLAR WITH INTERIOR LOCK ELEMENTS

(71) Applicant: INNOVEX DOWNHOLE SOLUTIONS, INC., Houston, TX (US)

(72) Inventors: Justin Kellner, Adkins, TX (US); Chris Cuffe, The Woodlands, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 176 days.

(21) Appl. No.: 16/689,646

(22) Filed: Nov. 20, 2019

(65) Prior Publication Data

US 2021/0148176 A1 May 20, 2021

(51) Int. Cl.
*E21B 17/16* (2006.01)

(52) U.S. Cl.
CPC ..... *E21B 17/16* (2013.01)

(58) Field of Classification Search
CPC ..... E21B 23/03; E21B 17/02; E21B 17/16
See application file for complete search history.

(56) References Cited

U.S. PATENT DOCUMENTS 2,855,052 A * 10/1958 Wright ..... E21B 37/02 166/243

* cited by examiner

*Primary Examiner* — Cathleen R Hutchins
*Assistant Examiner* — Ronald R Runyan
(74) *Attorney, Agent, or Firm* — MH2 Technology Law Group LLP

(57) ABSTRACT

A stop collar includes an annular body and a gripping member. The body includes an outer surface and an inner surface. The body defines a window extending from the outer surface to the inner surface. A portion of the inner surface has a diameter that decreases proceeding toward an axial end of the body. The gripping member is positioned at least partially within the body and in contact with the inner surface. The gripping member is at least partially aligned with the window when the stop collar is in a first state. The gripping member moves toward the axial end of the body when the stop collar actuates into a second state. A diameter of the gripping member decreases as the gripping member moves toward the axial end of the body.

22 Claims, 12 Drawing Sheets

STOP COLLAR WITH INTERIOR LOCK ELEMENTS

BACKGROUND

Tubulars are assembled to form drill strings, casing strings, etc. and are deployed in a wellbore in a subterranean formation. Oftentimes, a device is coupled to the exterior of one of the tubulars. In various examples, such devices may include a bore wall scraper, a wiper, a packer, a centralizer, or a landing collar. The devices may be secured between two tubular couplings or ends of a tubular. In some cases, however, it may be desired to hold the devices in place away from the ends, e.g., without allowing the devices to slide all the way along a tubular. Stop collars, in such cases, may be attached to the exterior of the tubular, and may be used to limit or prevent movement of the device along the exterior surface of the tubular.

SUMMARY

A stop collar is disclosed. The stop collar includes an annular body and a gripping member. The body includes an outer surface and an inner surface. The body defines a window extending from the outer surface to the inner surface. A portion of the inner surface has a diameter that decreases proceeding toward an axial end of the body. The gripping member is positioned at least partially within the body and in contact with the inner surface. The gripping member is at least partially aligned with the window when the stop collar is in a first state. The gripping member moves toward the axial end of the body when the stop collar actuates into a second state. A diameter of the gripping member decreases as the gripping member moves toward the axial end of the body.

In another embodiment, the stop collar includes an annular body that includes an outer surface and an inner surface. The body defines a first window extending from the outer surface to the inner surface. A first portion of the inner surface has a diameter that decreases proceeding toward a first axial end of the body, and a second portion of the inner surface has a diameter that decreases proceeding toward a second axial end of the body. The stop collar also includes a first gripping member positioned at least partially within the body and in contact with the inner surface. The first gripping member is substantially C-shaped and biased radially-outward. The first gripping member is at least partially aligned with the first window when the stop collar is in a first state. The first gripping member moves toward the first axial end of the body when the stop collar actuates into a second state. A diameter of the first gripping member decreases as the first gripping member moves toward the first axial end of the body. The stop collar also includes a second gripping member positioned at least partially within the body and in contact with the inner surface. The second gripping member is at least partially aligned with the first window when the stop collar is in the first state. The second gripping member moves toward the second axial end of the body when the stop collar actuates into the second state. A diameter of the second gripping member decreases as the first gripping member moves toward the second axial end of the body.

In yet another embodiment, the stop collar includes an annular body including an outer surface and an inner surface. A first portion of the inner surface has a diameter that decreases proceeding toward a first axial end of the body. The stop collar also includes a gripping member positioned at least partially within the body and in contact with the inner surface. The gripping member is substantially C-shaped and biased radially-inward. The stop collar also includes a pin coupled to the gripping member when the stop collar is in a first state. The pin prevents a diameter of the gripping member from decreasing. The pin is configured to be pulled from the gripping member, which allows the stop collar to actuate into a second state. The diameter of the gripping member decreases as the stop collar actuates into the second state.

A method for actuating a stop collar is also disclosed. The method includes sliding the stop collar along an outer surface of a tubular. The stop collar includes an annular body including an outer surface and an inner surface. The body defines a window extending from the outer surface to the inner surface. A portion the inner surface defines a diameter that decreases proceeding toward an axial end of the body. The stop collar also includes a gripping member positioned at least partially within the body and in contact with the inner surface. The gripping member is at least partially aligned with the window. The method also includes actuating the stop collar from a first state to a second state. The gripping member moves toward the axial end of the body when the stop collar actuates from the first state to the second state.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
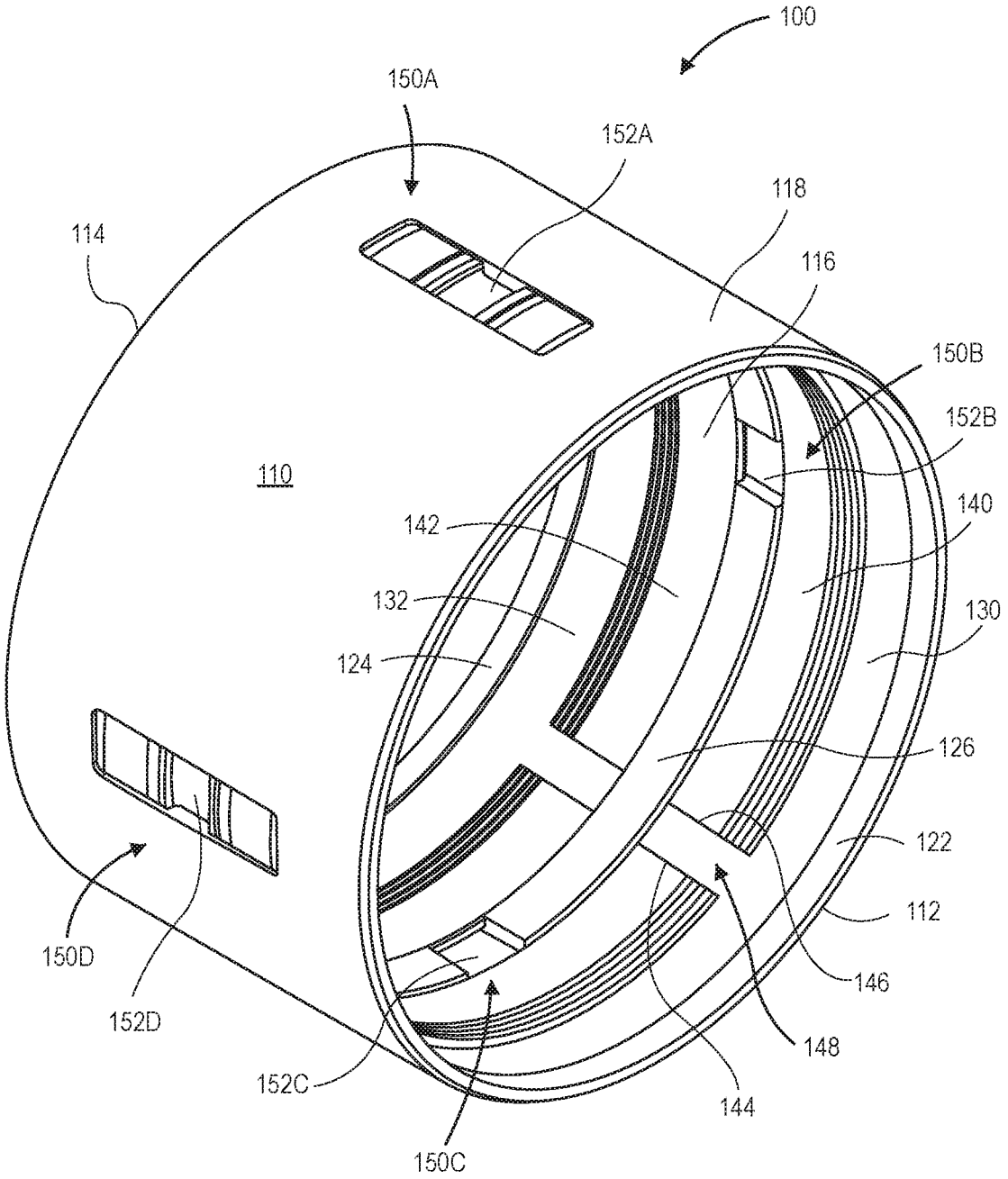
FIG. 1 illustrates a perspective view of a stop collar in a first (e.g., unset) state, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a stop collar 100 in a first (e.g., unset) state, according to an embodiment. The stop collar 100 may include an annular body 110 having a first axial end 112 and a second axial end 114. The annular body 110 may define an inner surface 116 and an outer surface 118, defining the radial inside and outside thereof.

The inner surface 116 may define a first shoulder 122 proximate to the first axial end 112 and a second shoulder 124 proximate to the second axial end 114. The inner surface 116 may also define a third shoulder (also referred to as an intermediate shoulder) 126 positioned between the first and second shoulders 122, 124. The shoulders 122, 124, 126 may protrude radially-inward from a remainder of the inner surface 116, thereby at least partially defining a first recess 130 between the first shoulder 122 and the intermediate shoulder 126 and a second recess 132 between the second shoulder 124 and the intermediate shoulder 126.

The stop collar 100 may include one or more gripping members (two are shown: 140, 142). As shown, the first gripping member 140 may be positioned at least partially in the first recess 130, and the second gripping member 142 may be positioned at least partially in the second recess 132. In one embodiment, the gripping members 140, 142 may be or include C-shaped members that extend from about 270° to about 355°. When the gripping members 140, 142 are C-shaped, they may each include two circumferential ends 144, 146 with a circumferential gap 148 therebetween. Although the gripping members 140, 142 may be substantially C-shaped, rather than fully annular or ring-shaped, they may considered to have a diameter, as described below.

The gripping members 140, 142 may be biased radially-outward. As discussed in greater detail below, when the gripping members 140, 142 are exposed to a radially-inward force, the circumferential ends 144, 146 may move closer together, causing a diameter of the gripping members 140, 142 to decrease. The gripping members 140, 142 may include ridges or teeth on an inner surface thereof to grip (e.g., bite into) an outer surface of a tubular such as a drill pipe segment or a casing segment as the diameters of the gripping members 140, 142 decrease.

The body 110 may include one or more windows (four are shown: 150A, 150B, 150C, 150D). The windows 150A-150D may be formed radially-through the body 110 (e.g., from the inner surface 116 to the outer surface 118). The windows 150A-150D may extend through the intermediate shoulder 126. The windows 150A-150D may be circumferentially-offset from one another. In the example shown, there are four windows 150A-150D that are spaced apart at 90° intervals around the circumference of the body 110.

When the stop collar 100 is in the first (e.g., unset) state, the gripping members 140, 142 may be at least partially aligned with the windows 150A-150D. Thus, as may be seen in FIG. 1, when the stop collar 100 is in the first (e.g., unset) state, the gripping members 140, 142 may be at least partially visible through the windows 150A-150D, with a gap 152A-152D being positioned axially-between the gripping members 140, 142.

Figure 2:
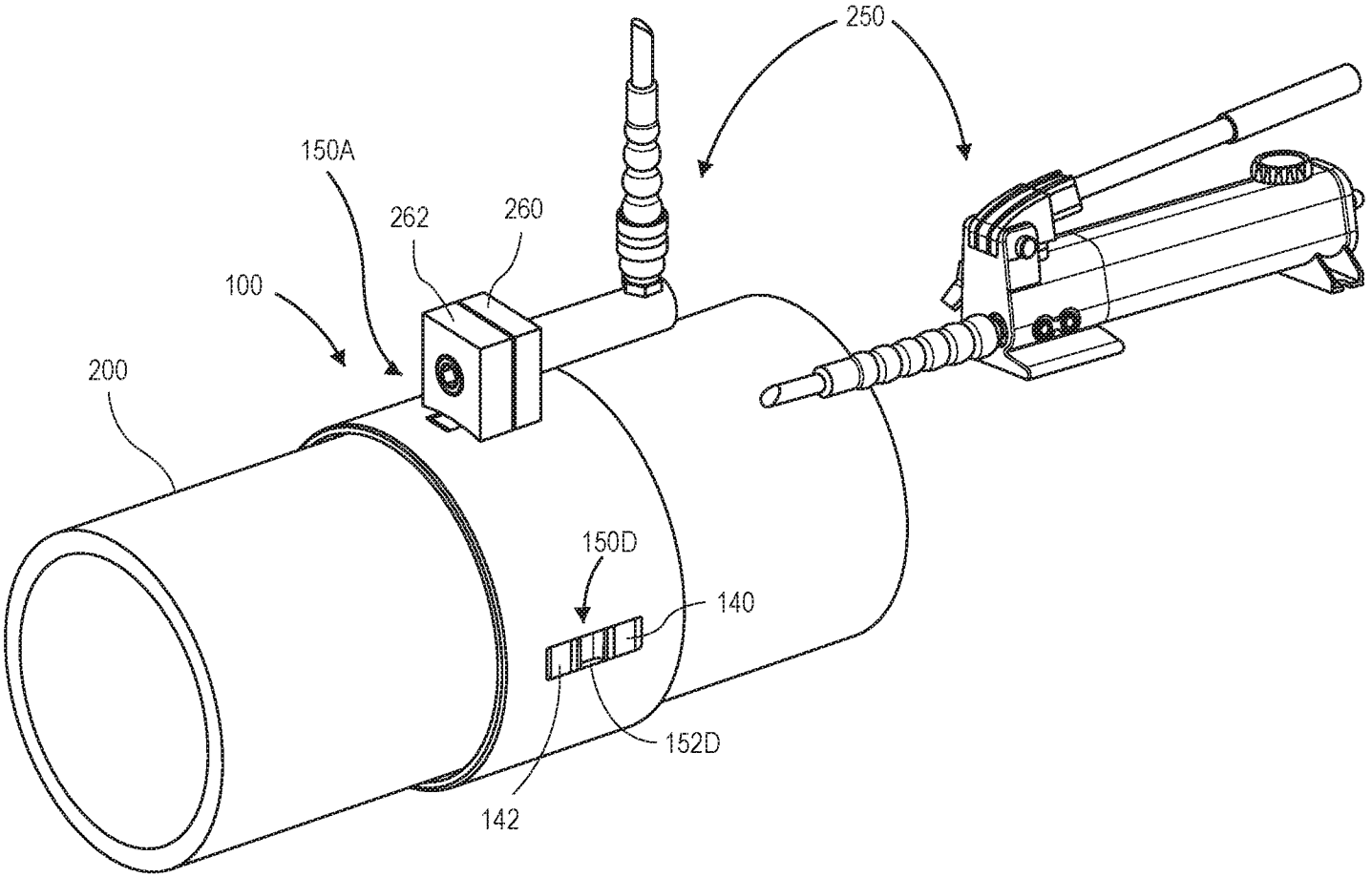
FIG. 2 illustrates a perspective view of the stop collar in the first state positioned around a tubular, according to an embodiment.
Figure 3:
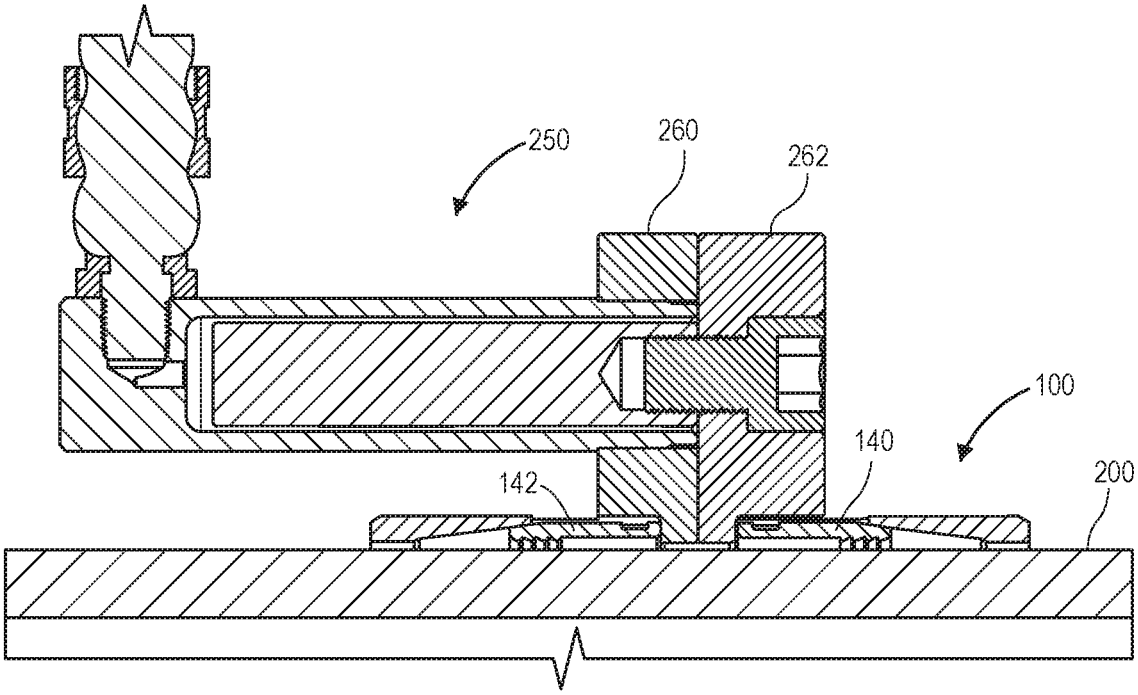
FIG. 3 illustrates a cross-sectional view of a portion of FIG. 2, according to an embodiment.

FIG. 2 illustrates a perspective view of the stop collar 100 in the first (e.g., unset) state positioned around a tubular 200, and FIG. 3 illustrates a cross-sectional view of a portion of FIG. 2, according to an embodiment. When the stop collar 100 is in the desired position on the outer surface of the tubular 200, a setting tool 250 may be connected to the stop collar 100. The setting tool 250 may include one or more arms (two are shown: 260, 262). The setting tool 250 may be connected to the stop collar 100 by introducing at least a portion of the arms 260, 262 at least partially into or through one (or more) of the windows (e.g., window 150A). For example, the portion of the arms 260, 262 may be positioned through one of the gaps (e.g., gap 152A—see FIG. 1) between the gripping members 140, 142.

Figure 4:
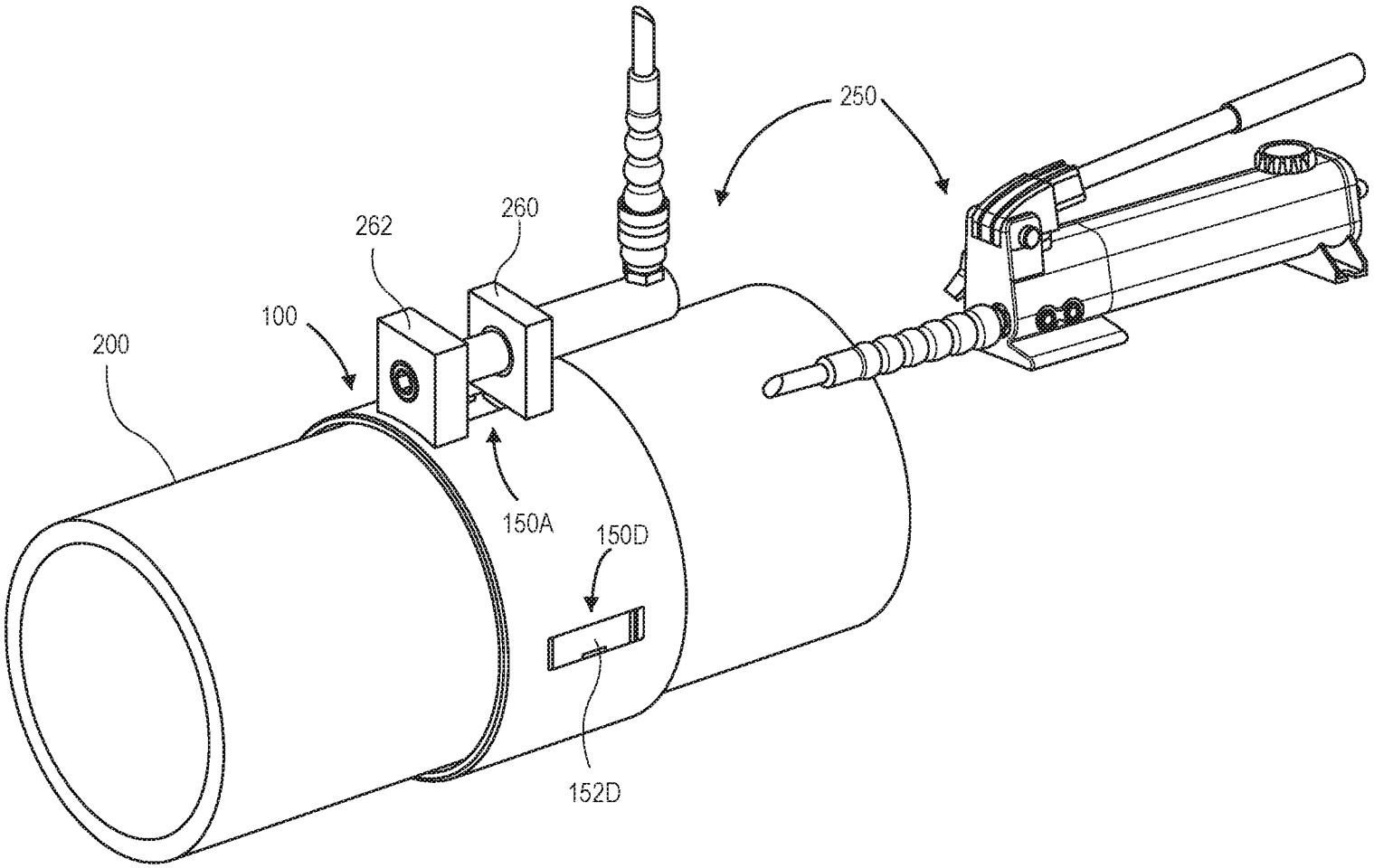
FIG. 4 illustrates a perspective view of the stop collar in a second (e.g., set) state positioned around the tubular, according to an embodiment.
Figure 5:
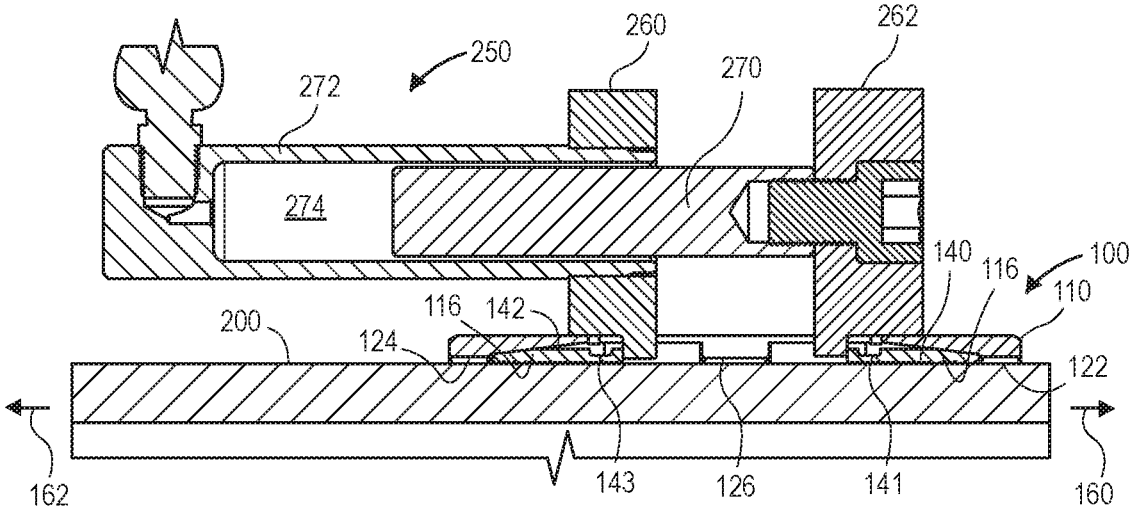
FIG. 5 illustrates a cross-sectional view of a portion of FIG. 4, according to an embodiment.

FIG. 4 illustrates a perspective view of the stop collar 100 in a second (e.g., set) state positioned around the tubular, and FIG. 5 illustrates a cross-sectional view of a portion of FIG. 4, according to an embodiment. The setting tool 250 may actuate the stop collar 100 into the second (e.g., set) state by moving the arms 260, 262 apart from one another. As the arms 260, 262 move apart, they may push the gripping members 140, 142 farther apart from one another. The first and second shoulders 122, 124 may serve as stops that limit the axial movement of the gripping members 140, 142, respectively. In addition, the shoulders 122, 124, 126 may also serve to increase the rigidity and structural integrity of the body 110.

As may be seen in FIG. 5, the inner surface 116 of the body 110 may be tapered. More particularly, the diameter of the inner surface 116 may decrease proceeding from the intermediate shoulder 126 toward the first shoulder 122, and from the intermediate shoulder 126 toward the second shoulder 124. In at least one embodiment, the outer surfaces of the gripping members 140, 142 may have a complimentary tapering profile. As a result of the tapering surfaces, as the gripping members 140, 142 move farther apart, the body 110 may exert an increasing radially-inward force onto the gripping members 140, 142, which causes the gripping members 140, 142 to exert an increasing radially-inward gripping force on the tubular 200. This may cause the ridges or teeth of the gripping members 140, 142 to grip (e.g., bite into) the outer surface of the tubular 200. Thus, the gripping members 140, 142 may grip (e.g., bite into) the tubular 200 such that the gripping members 140, 142 to do not move with respect to the tubular 200 (i.e., they are anchored).

Once the gripping members 140, 142 are anchored to the tubular 200, the body 110 may be substantially prevented from moving axially and/or radially with respect to the gripping members 140, 142 and/or the tubular 200 due to a friction fit between the body 110 and the gripping members 140, 142. For example, if the body 110 is subjected to an axial force in a first direction 160 (see FIG. 5), then the tapering engagement between the second gripping member 142 and the inner surface 116 of the body 110 may substantially prevent the body 110 from moving in the first direction 160. If the body 110 is subjected to an axial force in a second direction 162, then the tapering engagement between the first gripping member 140 and the inner surface 116 of the body 110 may substantially prevent the body 110 from moving in the second direction 162.

Referring again to FIG. 5, the outer surfaces of the gripping members 140, 142 may include recesses 141, 143. The recesses 141, 143 may be visible through the windows 150A-150D, even after the stop collar 100 is in the second (e.g., set) state. As such, the recesses 141, 143 may be configured to receive the setting tool 250 or an unsetting tool (e.g., snap-ring pliers) when the stop collar 100 is in the second (e.g., set) state. As discussed in greater detail below, the setting tool 250 or the unsetting tool may then pull the gripping members 140, 142 closer together to actuate the stop collar 100 back into the first (e.g., unset) state.

The setting tool 250 may include a piston 270 and a cylinder 272. The piston 270 may be positioned at least partially within the cylinder 272. In at least one embodiment, the setting tool 250 may be hydraulic. Thus, a hydraulic fluid may be pumped into a space 274 in the cylinder 272, which causes the piston 270 to extend. As may be seen, the first arm 260 may be coupled to (and move together with) the piston 270, and the second arm 262 may be coupled to (and move together with) the cylinder 272.

Figure 6:
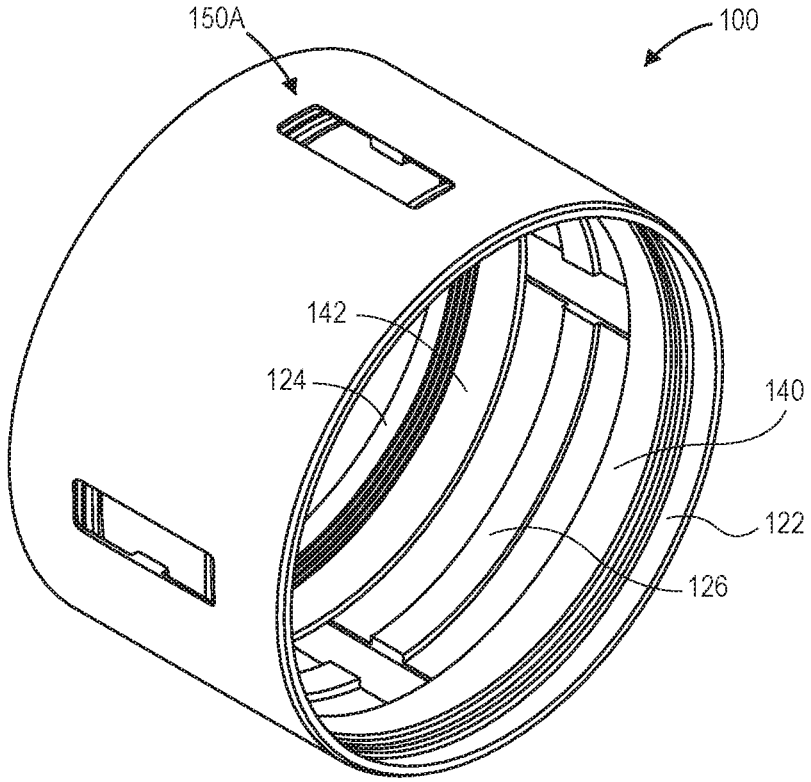
FIG. 6 illustrates a perspective view of the stop collar in the second state, according to an embodiment.

FIG. 6 illustrates a perspective view of the stop collar 100 in the second (e.g., set) state, according to an embodiment. The setting tool 250 may be withdrawn from the window 150A after the stop collar 100 is in the second (e.g., set) state. As may be seen, when the stop collar 100 is in the second (e.g., set) state, the gripping members 140, 142 may be closer to the shoulders 122, 124 than they were in the first (e.g., unset) state. In one example, the gripping members 140, 142 may be in contact with (e.g., abutting) the shoulders 122, 124 such that the shoulders 122, 124 act as a physical stop or barrier. In another example, the gripping members 140, 142 may not be in contact with (e.g., abutting) the shoulders 122, 124. More particularly, as the gripping members 140, 142 slide axially apart and contract radially-inward, the gripping members 140, 142 may be configured to contact tubulars of different outer diameters.

In the first state, one or more of the shoulders 122, 124, 126 may protrude radially-inward farther than the gripping members 140, 142. As described below, this may facilitate moving the stop collar 100 axially along the outer surface of the tubular 200. However, when the stop collar 100 is in the second state, the gripping members 140, 142 protrude radially-inward farther than the shoulders 122, 124, 126. As described below, this may facilitate gripping the outer surface of the tubular 200 to reduce or prevent the axial movement.

Figure 7:
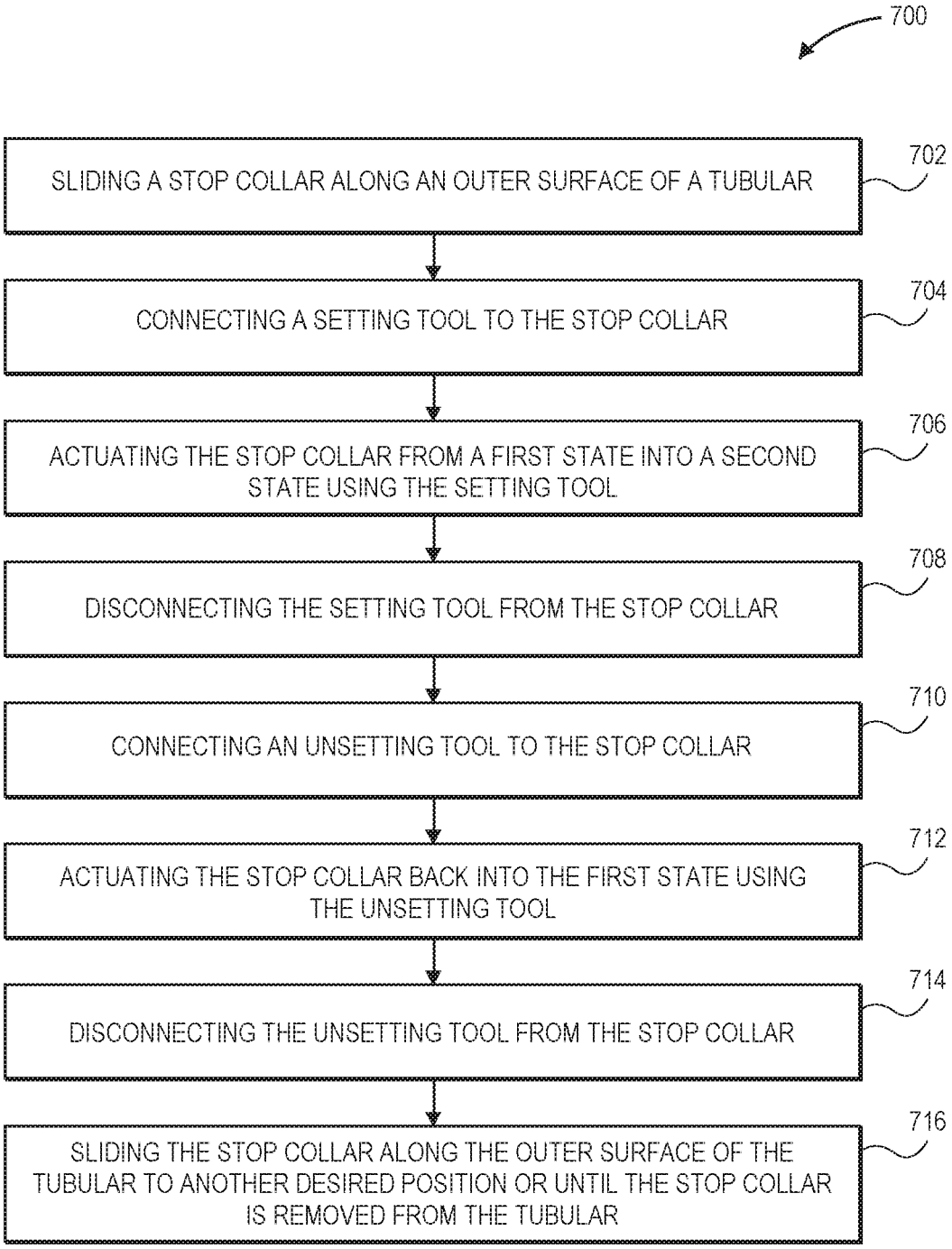
FIG. 7 illustrates a flowchart of a method for actuating the stop collar from the first state to the second state, according to an embodiment.

FIG. 7 illustrates a flowchart of a method 700 for actuating the stop collar 100 from the first (e.g., unset) state to the second (e.g., set) state, according to an embodiment. An illustrative order of the method 700 is provided below; however, as will be appreciated, at least a portion of the method 700 may be performed in a different order or omitted altogether.

The method 700 may include sliding the stop collar 100 along an outer surface of the tubular 200 to a desired position, as at 702. The stop collar 100 may be in the first (e.g., unset) state when the stop collar 100 slides along the outer surface of the tubular 200. As mentioned above, one or more of the shoulders 122, 124, 126 may protrude radially-inward farther than the gripping members 140, 142 when the stop collar 100 is in the first (e.g., unset) state and slides along the outer surface of the tubular 200. Further, the gripping members 140, 142 may be biased radially-outward, against the inner surface 116 and into the recesses 130, 132, respectively. As such, the gripping members 140, 142 may not contact and/or drag along the outer surface of the tubular 200 as the stop collar 100 slides along the outer surface of the tubular 200.

The method 700 may also include connecting the setting tool 250 to the stop collar 100, as at 704. This may include introducing the arms 260, 262 of the setting tool 250 into or through the window 150A such that the arms 260, 262 are positioned at least partially between the gripping members 140, 142. This is shown in FIGS. 2 and 3.

The method 700 may also include actuating the stop collar 100 into the second (e.g., set) state using the setting tool 250, as at 706. This may include moving the arms 260, 262 of the setting tool 250 apart from one another, which may push the gripping members 140, 142 farther apart from one another. This is shown in FIGS. 4 and 5. As described above, as the gripping members 140, 142 move farther apart from one another, the radially-inward force imparted by the body 110 onto the gripping members 140, 142, and imparted by the gripping members 140, 142 onto the tubular 200, may progressively increase.

The method 700 may also include disconnecting the setting tool 250 from the stop collar 100, as at 708. After the stop collar 100 is in the second (e.g., set) state, the setting tool 250 may be disconnected therefrom. This may include withdrawing the arms 260, 262 of the setting tool 250 from the window 150A.

In at least one embodiment, the steps 704, 706, and/or 708 may be performed for each window 150A-150D simultaneously. In another embodiment, the steps 704, 706, and/or 708 may be performed sequentially for the windows 150A-150D. When performed sequentially, the steps 704, 706, and/or 708 may be performed for the windows 150A-150D in a clockwise manner (e.g., window 150A first, window 150B second, window 150C, third, and window 150D fourth) or in a counterclockwise manner. Alternatively, when performed sequentially, the steps 704, 706, and/or 708 may be performed in a star pattern (e.g., window 150A first, window 150C second, window 150B, third, and window 150D fourth). The shoulders 122, 124 may restrict misalignment of the gripping members 140, 142 when the setting is performed sequentially.

The method 700 may also include or connecting an unsetting tool to the stop collar 100, as at 710. The unsetting tool may be connected when the stop collar 100 is in the second (e.g., set) state. Connecting the unsetting tool may include introducing the arms of the unsetting tool through the window 150A such that the arms are positioned at least partially within the recesses 141, 143 in the upper surfaces of the gripping members 140, 142.

The method 700 may also include actuating the stop collar 100 back into the first (e.g., unset) state using the unsetting tool, as at 712. This may include moving the arms of the unsetting tool toward one another, which may pull the gripping members 140, 142 toward one another. As the gripping members 140, 142 move toward one another, the radially-inward force imparted by the body 110 onto the gripping members 140, 142, and imparted by the gripping members 140, 142 onto the tubular 200, may progressively decrease. As mentioned above, the gripping members 140, 142 may be biased radially-outwards. As a result, when the gripping members 140, 142 move toward one another, they may proceed to expand radially-outward due to the tapering inner surface 116 of the body 110 until they are no longer in contact with the outer surface of the tubular 200.

The method 700 may also include disconnecting the unsetting tool from the stop collar 100, as at 714. When the stop collar 100 is in the first (e.g., unset) state, the unsetting tool may be disconnected therefrom. This may include withdrawing the arms of the unsetting tool from the recesses 141, 143 in the upper surfaces of the gripping members 140, 142 and from the window 150A. The steps 710, 712, and/or 714 may be performed for each window 150A-150D simultaneously or sequentially. In addition, the steps 710, 712, and/or 714 may also be performed using the setting tool 250 instead of the unsetting tool.

The method 700 may also include sliding the stop collar 100 along the outer surface of the tubular 200 to another desired position or until the stop collar 100 is removed from the tubular 200, as at 716.

Figure 8:
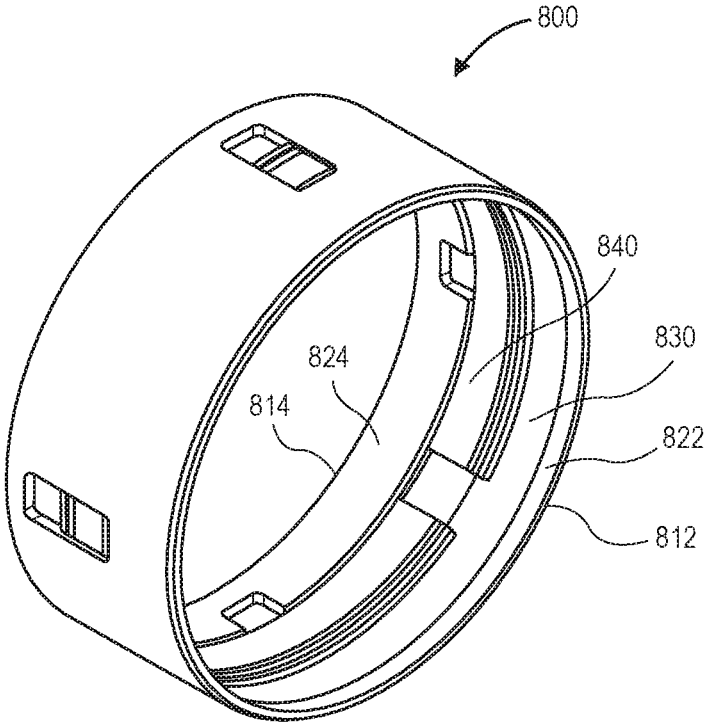
FIG. 8 illustrates a perspective view of a second stop collar in a first (e.g., unset) state, according to an embodiment.
Figure 9:
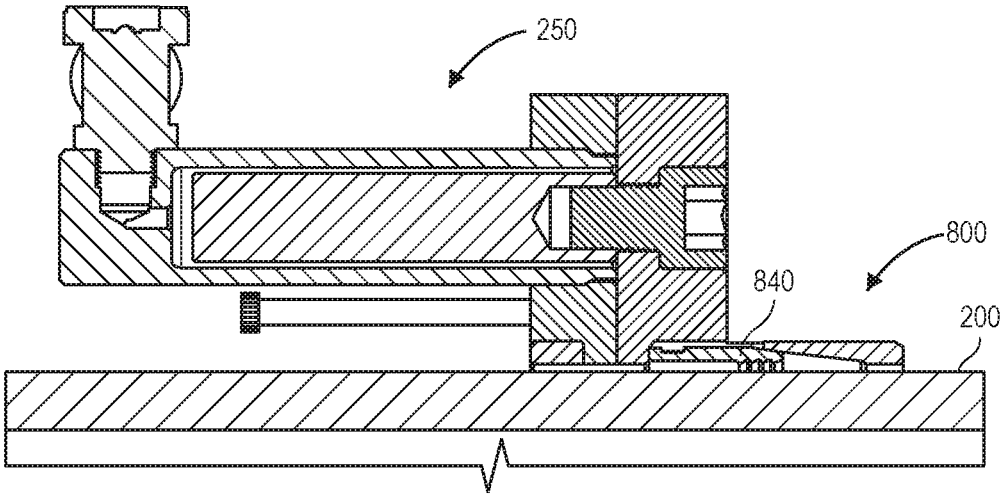
FIG. 9 illustrates a cross-sectional view of the second stop collar in the first state positioned around the tubular, according to an embodiment.

FIG. 8 illustrates a perspective view of a second stop collar 800 in a first (e.g., unset) state, and FIG. 9 illustrates a cross-sectional view of the second stop collar 800 in the first state positioned around the tubular 200, according to an embodiment. The second stop collar 800 may be similar to the stop collar 100 described above with respect to FIGS. 1-7; however, the second stop collar 800 may include only a single gripping member 840. More particularly, the second stop collar 800 may include a first shoulder 822 proximate to a first axial end 812 of the body 810, and a second shoulder 824 proximate to a second axial end 814 of the body 810. A recess 830 may be defined at least partially by/between the first and second shoulders 822, 824, and the gripping member 840 may be positioned at least partially within the recess 830.

Figure 10:
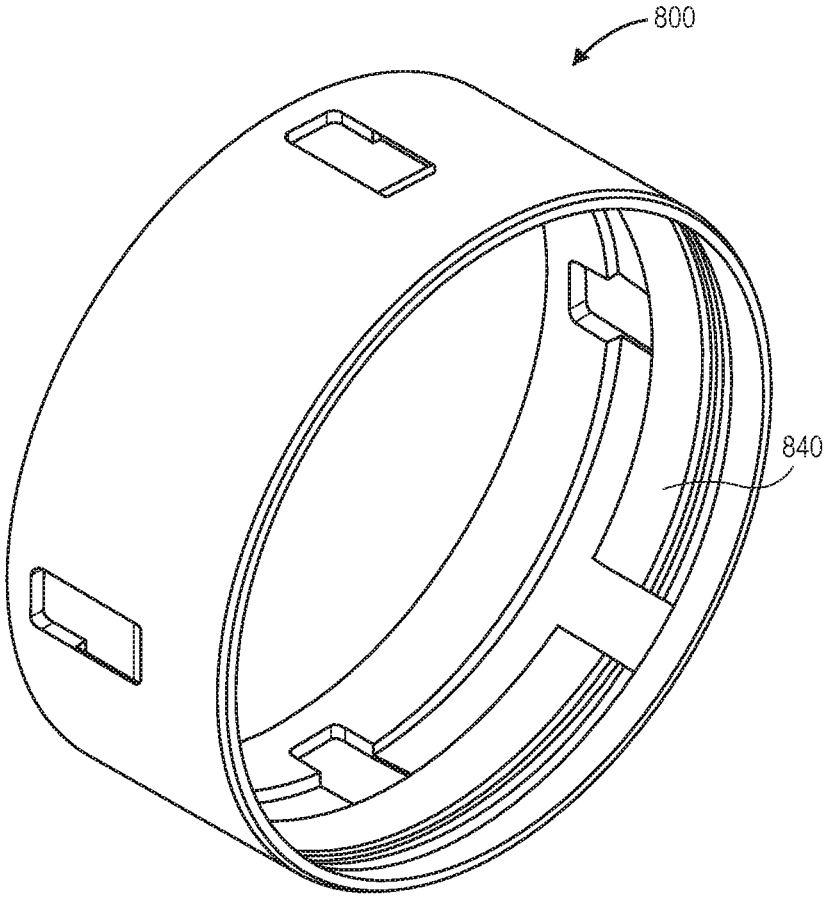
FIG. 10 illustrates a perspective view of the second stop collar in a second (e.g., set) state, according to an embodiment.
Figure 11:
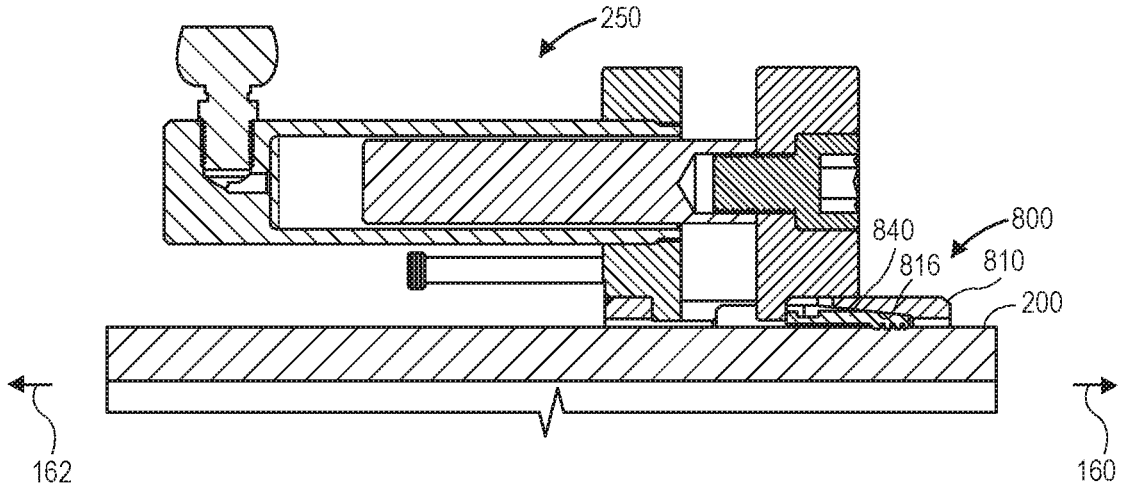
FIG. 11 illustrates a cross-sectional view of the second stop collar in the second state positioned around the tubular, according to an embodiment.

FIG. 10 illustrates a perspective view of the second stop collar 800 in a second (e.g., set) state, and FIG. 11 illustrates a cross-sectional view of the second stop collar 800 in the second (e.g., set) state positioned around the tubular 200, according to an embodiment. The second stop collar 800 may be actuated into the second (e.g., set) state in a similar manner to the stop collar 100 (e.g., similar to method 700). However, as the second stop collar 800 includes only a single gripping member 840, once in the second (e.g., set) state, the second stop collar 800 may substantially prevent the second stop collar 800 from moving in one axial direction, but may provide substantially less gripping force to oppose a force in the opposing axial direction. For example, if the body 810 is subjected to an axial force in the first direction 160, then the body 810 may move in the first direction 160 with respect to the gripping member 840 and the tubular 200, such that the second stop collar 800 actuates back into the first (e.g., unset) state. The second stop collar may then slide along the outer surface of the tubular 200 in the first direction 160. However, if the body 810 is subjected to an axial force in the second direction 862, then the tapering engagement between the gripping member 840 and the inner surface 816 of the body 810 may substantially prevent the body 810 from moving in the second direction 862.

Figure 12:
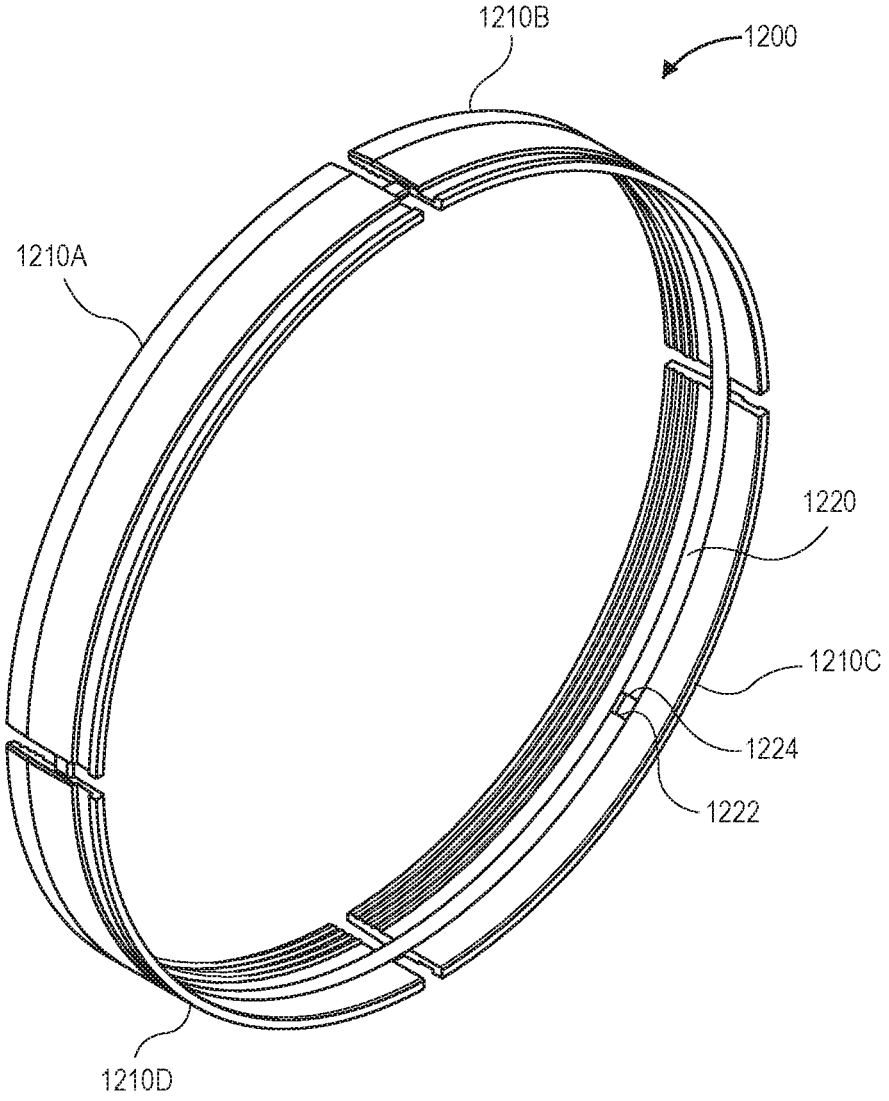
FIG. 12 illustrates a perspective view of an alternative gripping member that may be used in the stop collars, according to an embodiment.

FIG. 12 illustrates a perspective view of another gripping member 1200 that may be used in the stop collar 100 and/or the second stop collar 800, according to an embodiment. As shown, the gripping member 1200 may be or include a plurality of arcuate-shaped sub-members (four are shown: 1210A, 1210B, 1210C, 1210D). The sub-members 1210A-1210D may be circumferentially-offset from one another. Each of the sub-members 1210A-1210D may extend from about 30° to about 180°, about 45° to about 150°, or about 60° to about 130°. As shown, each of the sub-members 1210A-1210D extends slightly less than 90°.

The sub-members 1210A-1210D may be coupled to and/or in contact with a retaining member 1220. For example, each of the sub-members 1210A-1210D may define a recess on an inner surface thereof, and the retaining member 1220 may be positioned at least partially within the recesses. The retaining member 1220 may also or instead be adhered to the inner surfaces of the sub-members 1210A-1210D. The retaining member 1220 may be substantially C-shaped, such that it has a first circumferential end 1222 and a second circumferential end 1224. The retaining member 1220 may be biased radially-outward, which may bias the gripping member 1200 radially-outward.

The retaining member 1220 may be configured to slide within the recesses in the sub-members 1210A-1210D. Thus, when the gripping member 1200 is exposed to a radially-inward force (e.g., by body 110 or body 810), as described above, the circumferential ends 1222, 1224 may move toward one another, allowing the diameter of the gripping member 1200 to decrease (e.g., to contact and grip the outer surface of the tubular 200). In another embodiment, instead of or in addition to the circumferential ends 1222, 1224 moving toward one another in response to the radially-inward force, the retaining member 1220 may be configured to break in one or more places to allow the diameter of the gripping member 1200 to decrease (e.g., to contact and grip the exterior of the tubular 200).

Figure 13:
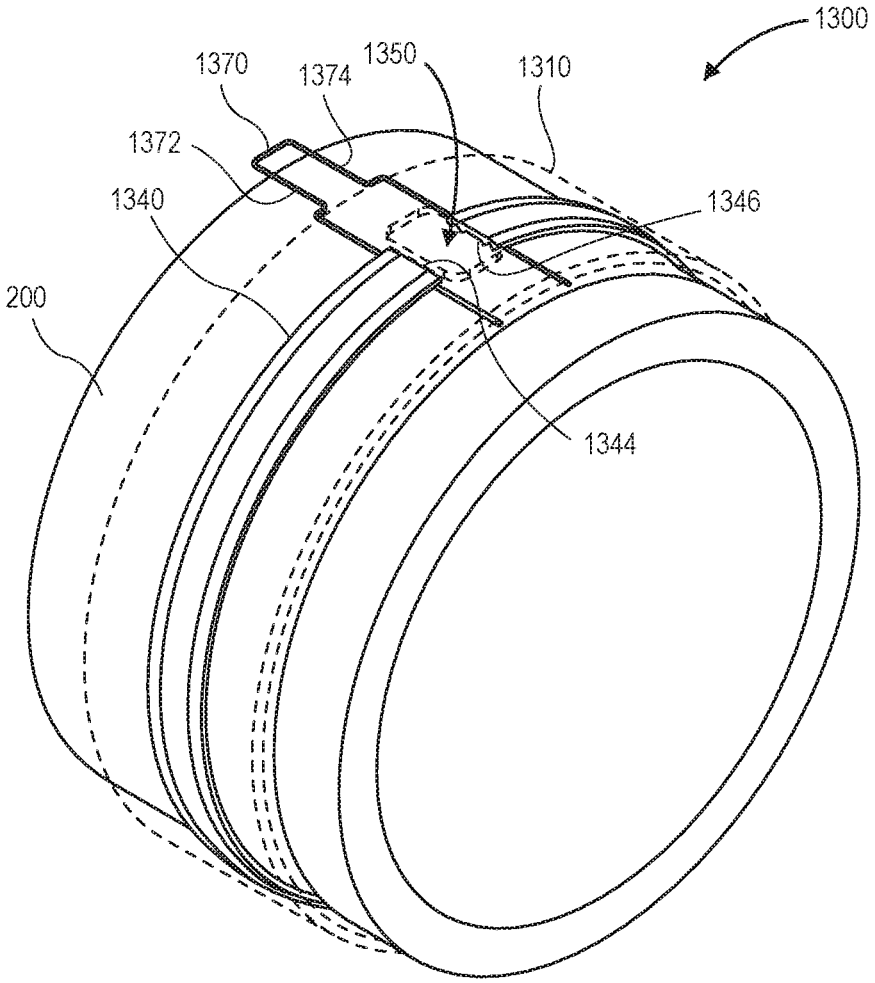
FIG. 13 illustrates a perspective view of a third stop collar in a first (e.g., unset) state and positioned around the tubular, according to an embodiment.

FIG. 13 illustrates a perspective view of a third stop collar 1300 in a first (e.g., unset) state and positioned around the tubular 200, according to an embodiment. The third stop collar 1300 may include a body 1310 (shown in dashed lines in FIG. 13). The body 1310 may include one or more windows (one is shown: 1350). The window 1350 may be formed radially-through the body 1310 (e.g., from the inner surface to the outer surface).

The stop collar 1300 may also include a gripping member 1340 positioned at least partially within the body 1310. More particularly, the gripping member 1340 may be positioned radially-between the body 1310 and the tubular 200. In FIG. 13, the body 1310 is shown transparent (dashed lines) so that the gripping member 1340 may be seen. The gripping member 1340 may be substantially C-shaped. Thus, the gripping member 1340 may include a first circumferential end 1344 and a second circumferential end 1346 that are spaced apart from one another when the third stop collar 1300 is in the first (e.g., unset) state. In the embodiment shown, the first circumferential end 1344 is proximate to (e.g., substantially aligned with) a first circumferential side of the window 1350, and the second circumferential end 1346 is proximate to a second circumferential side of the window 1350.

The stop collar 1300 may also include a pin (also referred to as a "shipping" pin) 1370. The pin 1370 may include a first arm 1372 and a second arm 1374. Thus, the pin 1370 may be substantially U-shaped. The pin 1370 may be positioned radially-inward from the body 1310 and/or at least partially through the body 1310. The pin 1370 may be coupled to the gripping member 1340. More particularly, the arms 1372, 1374 may be coupled to the circumferential ends 1344, 1346 of the gripping member 1340, respectively. The gripping member 1340 may be biased radially-inward, and the pin 1370, when coupled to the gripping member 1340, may prevent the circumferential ends 1344, 1346 from moving closer together and causing the diameter of the gripping member 1340 to decrease.

Figure 15:
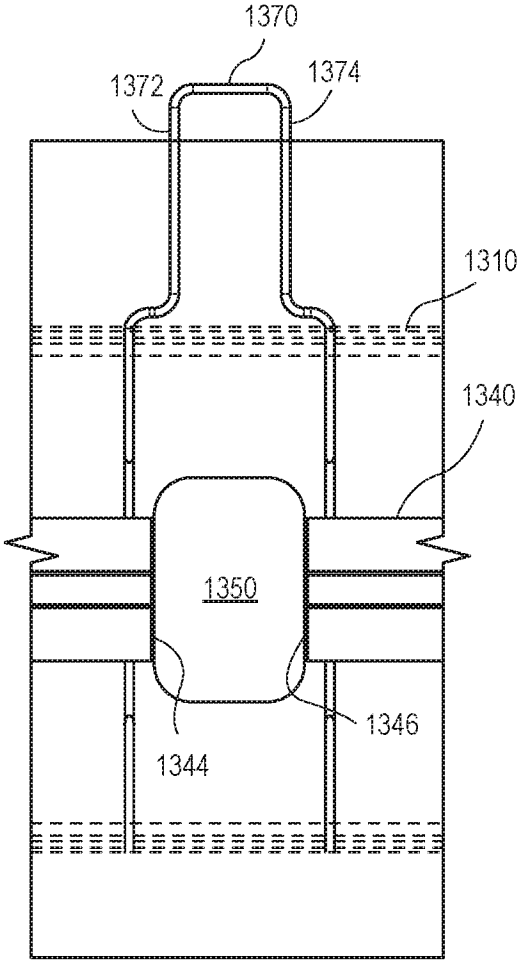
FIG. 15 illustrates a top view of FIG. 14, according to an embodiment.
Figure 14:
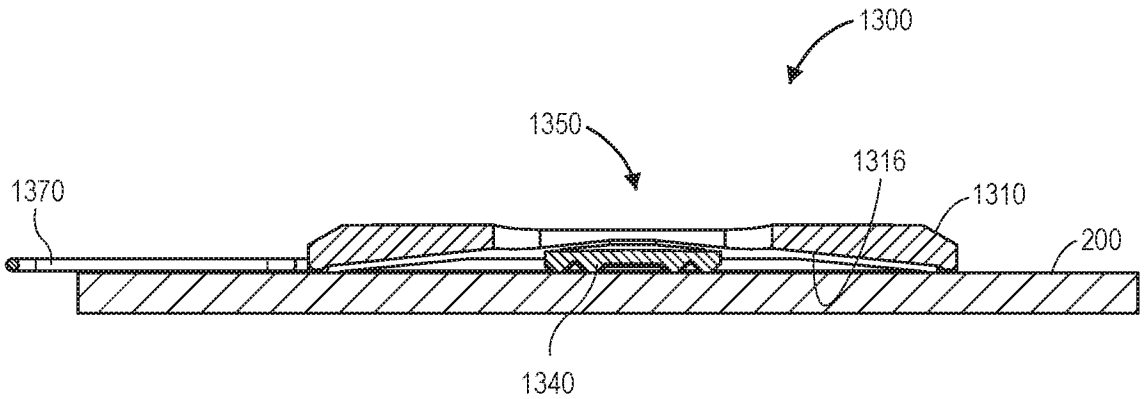
FIG. 14 illustrates a cross-sectional view of a portion of the third stop collar in the first state and positioned around the tubular, according to an embodiment.

FIG. 14 illustrates a cross-sectional view of a portion of the third stop collar 1300 in the first (e.g., unset) state and positioned around the tubular 200, and FIG. 15 illustrates a top view of FIG. 14, according to an embodiment. The inner surface 1316 of the body 1310 of the stop collar 1300 may be tapered, similar to the stop collars 100, 800 described above. The gripping member 1340 may be positioned substantially in the middle of the body 1310 (e.g., the portion of the body 1310 with the greatest inner diameter) when the third stop collar 1300 is in the first (e.g., unset) state. The pin 1370 may be positioned radially-inward from the body 1310 and/or at least partially through the body 1310. The pin 1370 may extend at least partially through the gripping member 1340 to provide the coupling therewith.

Figure 17:
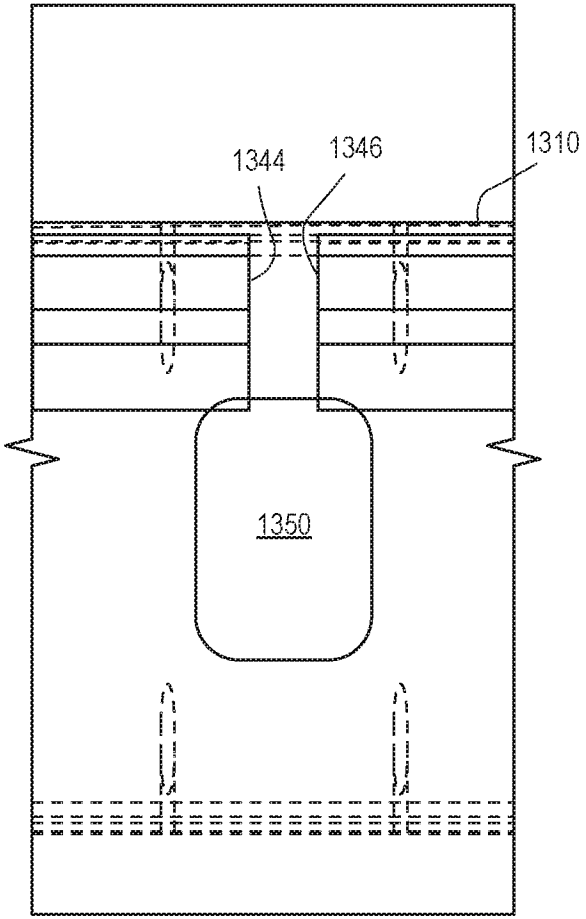
FIG. 17 illustrates a top view of FIG. 16, according to an embodiment.
Figure 16:
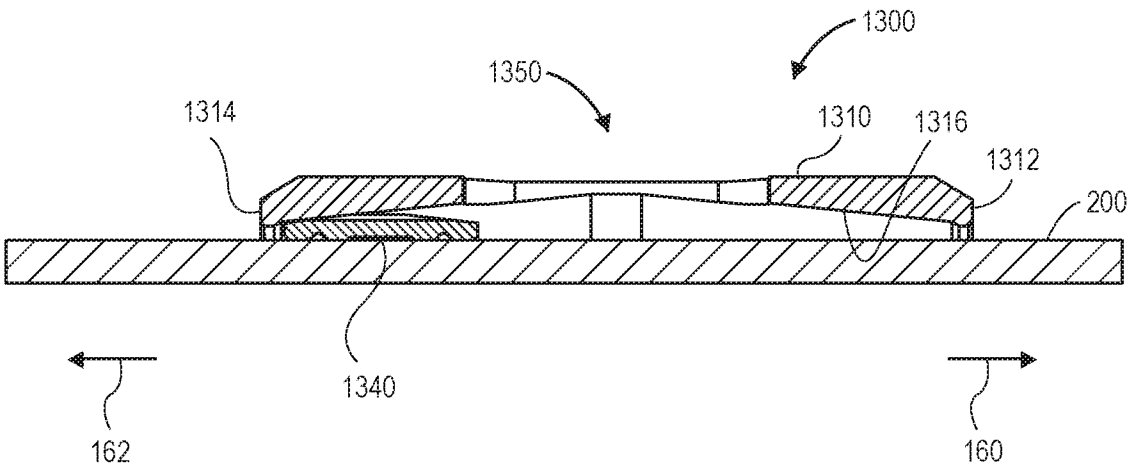
FIG. 16 illustrates a cross-sectional view of a portion of the third stop collar in a second (e.g., set) state and positioned around the tubular, according to an embodiment.

FIG. 16 illustrates a cross-sectional view of a portion of the third stop collar 1300 in a second (e.g., set) state and positioned around the tubular 200, and FIG. 17 illustrates a top view of FIG. 16, according to an embodiment. The third stop collar 1300 may be actuated into the second (e.g., set) state by pulling the pin 1370. Once the pin 1370 has been removed, the radial-inward bias of the gripping member 1340 may cause the circumferential ends 1344, 1346 to move closer together, thereby decreasing the diameter of the gripping member 1340. As the diameter decreases, the inner surface of the gripping member 1340 may contact the outer surface of the tubular 200.

The body 1310 may then slide axially along the outer surface of the tubular 200 a predetermined distance that is less than or equal to the length of the body 1310. For example, if the body 1310 is subjected to an axial force in the first direction 160 (as shown), the body 1310 may slide in the first direction 160 until the inner surface 1316 of the body 1310 proximate to the second axial end 1314 contacts the gripping member 1340. The tapering engagement between the inner surface 1316 of the body 1310 and the outer surface of the gripping member 1340 may then exert a radially-inward force on the gripping member 1340, which may cause the gripping member 1340 to exert a radially-inward force on the tubular 200. Similarly, if the body 1310 is subjected to an axial force in the second direction 162, the body 1310 may slide in the second direction 162 until the inner surface 1316 of the body 1310 proximate to the first axial end 1312 contacts the gripping member 1340. The tapering engagement between the inner surface 1316 of the body 1310 and the outer surface of the gripping member 1340 may then exert a radially-inward force on the gripping member 1340, which may cause the gripping member 1340 to exert a radially-inward force on the tubular 200.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A stop collar, comprising:

an annular body comprising an outer surface and an inner surface, wherein the body defines a first window extending from the outer surface to the inner surface, and wherein a first portion of the inner surface has a diameter that decreases proceeding toward a first axial end of the body; and a first gripping member positioned at least partially within the body and in contact with the inner surface, wherein the first gripping member is at least partially aligned with the first window when the stop collar is in a first state, wherein the first gripping member moves toward the first axial end of the body when the stop collar actuates into a second state, wherein the inner surface of the body defines an intermediate shoulder in the first and second states, and wherein a diameter of the first gripping member decreases as the first gripping member moves toward the first axial end of the body.

2. The stop collar of claim 1, wherein the first gripping member is substantially C-shaped and is biased radially-outward.

3. The stop collar of claim 1, wherein the body defines a second window radially-therethrough from the outer surface to the inner surface, and wherein the second window is circumferentially-offset from the first window.

4. The stop collar of claim 1, wherein the first gripping member is configured to be moved toward the first axial end of the body by a setting tool that accesses the first gripping member through the first window.

5. The stop collar of claim 4, wherein a second portion of the inner surface has a diameter that decreases proceeding toward a second axial end of the body, and wherein the stop collar further comprises a second gripping member positioned at least partially within the body and in contact with the inner surface, wherein the second gripping member is at least partially aligned with the first window, wherein the second gripping member is configured to be moved toward the second axial end of the body by the setting tool, and wherein a diameter of the second gripping member decreases as the second gripping member moves toward the second axial end of the body.

6. The stop collar of claim 5, wherein the intermediate shoulder is between the first gripping member and the second gripping member, and wherein the intermediate shoulder protrudes radially-inward.

7. The stop collar of claim 6, wherein the intermediate shoulder protrudes radially-inward farther than the first gripping member when the stop collar is in the first state, and wherein the first gripping member protrudes radially-inward farther than the intermediate shoulder when the stop collar is in the second state.

8. The stop collar of claim 7, wherein the first window extends through the intermediate shoulder.

9. The stop collar of claim 8, wherein the first window exposes a gap between the first gripping member and the second gripping member.

10. The stop collar of claim 1, wherein an outer surface of the first gripping member defines a recess, wherein the first gripping member is configured to be moved away from the first axial end of the body by an unsetting tool that accesses the recess of the first gripping member through the first window, and wherein the diameter of the first gripping member increases as the first gripping member moves away from the first axial end of the body.

11. A stop collar, comprising:

an annular body comprising an outer surface and an inner surface, wherein the body defines a first window extending from the outer surface to the inner surface, and wherein a first portion of the inner surface has a diameter that decreases proceeding toward a first axial end of the body, and a second portion of the inner surface has a diameter that decreases proceeding toward a second axial end of the body;

a first gripping member positioned at least partially within the body and in contact with the inner surface, wherein the first gripping member is substantially C-shaped and biased radially-outward, wherein the first gripping member is at least partially aligned with the first window when the stop collar is in a first state, wherein the first gripping member moves toward the first axial end of the body when the stop collar actuates into a second state, wherein the inner surface of the body defines an intermediate shoulder in the first and second states, and wherein a diameter of the first gripping member decreases as the first gripping member moves toward the first axial end of the body; and a second gripping member positioned at least partially within the body and in contact with the inner surface, wherein the second gripping member is at least partially aligned with the first window when the stop collar is in the first state, wherein the second gripping member moves toward the second axial end of the body when the stop collar actuates into the second state, and wherein a diameter of the second gripping member decreases as the second gripping member moves toward the second axial end of the body.

12. The stop collar of claim 11, wherein the intermediate shoulder is between the first gripping member and the second gripping member, wherein the intermediate shoulder protrudes radially-inward farther than the first gripping member when the stop collar is in the first state, and wherein the first gripping member protrudes radially-inward farther than the intermediate shoulder when the stop collar is in the second state.

13. The stop collar of claim 12, wherein the first gripping member is configured to be moved toward the first axial end of the body by a setting tool that accesses the first gripping member through the first window, and wherein the second gripping member is configured to be moved toward the second axial end of the body by the setting tool that accesses the first gripping member through the first window.

14. The stop collar of claim 13, wherein the first window extends through the intermediate shoulder, and wherein the first window exposes a gap between the first gripping member and the second gripping member.

15. The stop collar of claim 14, wherein the setting tool is positioned at least partially within the gap when the setting tool moves the first gripping member and the second gripping member.

16. A method for actuating a stop collar, comprising:

sliding the stop collar along an outer surface of a tubular, wherein the stop collar comprises:

an annular body comprising an outer surface and an inner surface, wherein the body defines a window extending from the outer surface to the inner surface, wherein the inner surface of the body comprises a shoulder proximate to the axial end, and wherein a portion the inner surface defines a diameter that decreases proceeding toward an axial end of the body; and a gripping member positioned at least partially within the body and in contact with the inner surface, wherein the gripping member is at least partially aligned with the window; and actuating the stop collar from a first state to a second state, wherein the gripping member moves toward the axial end of the body when the stop collar actuates from the first state to the second state.

17. The method of claim 16, further comprising connecting a setting tool to the stop collar, wherein connecting the setting tool to the stop collar comprises introducing an arm of the setting tool at least partially into or through the window such that the arm is adjacent to the gripping member, and wherein the stop collar is actuated from the first state to the second state using the setting tool.

18. The method of claim 17, wherein actuating the stop collar from the first state to the second state comprises moving the gripping member toward the axial end of the body with the arm of the setting tool, and wherein a diameter of the gripping member decreases as the gripping member moves toward the axial end of the body.

19. The method of claim 18, wherein the shoulder acts as a stop to limit axial movement of the gripping member.

20. The method of claim 18, further comprising actuating the stop collar from the second state back into the first state by introducing an unsetting tool into a recess formed in an outer surface of the gripping member and subsequently moving the gripping member away from the axial end of the body with the unsetting tool, and wherein the diameter of the gripping member increases as the gripping member moves away from the axial end of the body.

21. A stop collar, comprising:

an annular body comprising an outer surface and an inner surface, wherein the body defines a first window extending from the outer surface to the inner surface, and wherein a first portion of the inner surface has a diameter that decreases proceeding toward a first axial end of the body; and a first gripping member positioned at least partially within the body and in contact with the inner surface, wherein the first gripping member is at least partially aligned with the first window when the stop collar is in a first state, wherein the first gripping member moves toward the first axial end of the body when the stop collar actuates into a second state, wherein a diameter of the first gripping member decreases as the first gripping member moves toward the first axial end of the body, wherein an outer surface of the first gripping member defines a recess, wherein the first gripping member is configured to be moved away from the first axial end of the body by an unsetting tool that accesses the recess of the first gripping member through the first window, and wherein the diameter of the first gripping member increases as the first gripping member moves away from the first axial end of the body.

22. A stop collar, comprising:

an annular body comprising an outer surface and an inner surface, wherein the body defines a first window extending from the outer surface to the inner surface, and wherein a first portion of the inner surface has a diameter that decreases proceeding toward a first axial end of the body; and a first gripping member positioned at least partially within the body and in contact with the inner surface, wherein the first gripping member is at least partially aligned with the first window when the stop collar is in a first state, wherein the first gripping member moves toward the first axial end of the body when the stop collar actuates into a second state, and wherein a diameter of the first gripping member decreases as the first gripping member moves toward the first axial end of the body, wherein the inner surface of the body comprises a shoulder proximate to the first axial end that acts as a stop to limit axial movement of the first gripping member.

* * * * *